United States Patent [19]

Flanagan et al.

[11] Patent Number: 4,472,214

[45] Date of Patent: Sep. 18, 1984

[54] TRIAMINOGUANIDINIUM PHOSPHATE PROPELLANT ADDITIVE

[75] Inventors: Joseph E. Flanagan, Woodland Hills; Louis R. Grant, Los Angeles, both of Calif.

[73] Assignee: Rockwell International Corporation, El Segundo, Calif.

[21] Appl. No.: 530,325

[22] Filed: Sep. 8, 1983

Related U.S. Application Data

[62] Division of Ser. No. 389,742, Jun. 18, 1982, abandoned.

[51] Int. Cl.[3] ..... C06B 45/10

[52] U.S. Cl. ..... 149/19.6; 149/19.1; 149/36; 149/92

[58] Field of Search ..... 149/19.1, 19.6, 92, 149/36

[56] References Cited

U.S. PATENT DOCUMENTS

| | | | |
|---|---|---|---|
| 2,929,699 | 3/1960 | Audrieth et al. | 149/92 |
| 3,226,438 | 12/1965 | Oja et al. | 564/227 |
| 3,354,172 | 11/1967 | Takacs | 149/19.4 |
| 3,632,458 | 1/1972 | Filter | 149/19.4 |
| 3,813,439 | 5/1974 | Picard et al. | 564/227 |
| 3,954,528 | 5/1976 | Chang et al. | 149/19.4 |
| 4,002,514 | 1/1977 | Plomer et al. | 149/92 |
| 4,092,188 | 5/1978 | Lovelace | 149/92 |

OTHER PUBLICATIONS

Keim et al., *J. Am. Chem. Soc.,* 72, 4944–4946 (1950).

*Primary Examiner*—Edward A. Miller

*Attorney, Agent, or Firm*—H. Fredrick Hamann; Harry B. Field

[57] ABSTRACT

Triaminoguanidinium phosphate is used to improve the performance and flammability characteristics of low vulnerability propellants.

7 Claims, No Drawings

TRIAMINOGUANIDINIUM PHOSPHATE PROPELLANT ADDITIVE

This is a division of application Ser. No. 389,742, filed June 18, 1982, now abandoned.

BACKGROUND OF THE INVENTION

1. Field of the Invention

This invention pertains to pyrotechnics and more specifically to propellant additives.

2. Description of the Prior Art

From U.S. Pat. Nos. 4,113,775 and 3,950,421 there are given processes for the preparation of bis-triaminoguanidinium tetranitroethane and triaminoguanidinium nitrate, respectively. The former compound is a strong oxidizer in a solid propellant composition, whereas the latter material is a key ingredient in gun propellant formulations. However, in the gun propellant area, there is now an effort to alter the composition of the propellant such that accidental ignition is avoided. Thus, it would be desirable to include in gun propellants a triaminoguanidinium compound containing a less oxidizing anion, if such exists, since it would be less energetic than the ones cited above. A strong candidate for this intended purpose would be a triaminoguanidinium salt of phosphoric acid. Unfortunately, no such triaminoguanidinium salt was known in the prior art.

SUMMARY OF THE INVENTION

Accordingly, there is provided by the present invention a triaminoguanidinium salt of phosphoric acid and methods of making said salts. These salts are incorporated into a propellant to reduce the probability of accidental ignition.

OBJECTS OF THE INVENTION

Therefore, it is an object of the present invention to provide a triaminoguanidinium salt of phosphoric acid.

Another object of the present invention is to provide a method of preparing a triaminoguanidinium salt of phosphoric acid.

Yet another object of the present invention is to provide an ion-exchange method for producing a triaminoguanidinium salt of phosphoric acid.

An additional object of the present invention is to provide a free-base method for producing a triaminoguanidinium salt of phosphoric acid.

A further object of the present invention is to provide a triaminoguanidinium salt of phosphoric acid for incorporation into pyrotechnics to reduce the probability of accidental ignition.

Still another object of the present invention is to provide pyrotechnics having triaminoguanidinium salts of phosphoric acid incorporated therein.

Yet a further object of the present invention is to provide triaminoguanidinium phosphate.

Other objects, advantages and novel features of the present invention will become apparent from the following detailed description of the invention.

DESCRIPTION OF THE PREFERRED EMBODIMENTS

In accordance with the present invention, there is provided a new composition of matter comprising a triaminoguanidinium salt of phosphoric acid. These compositions serve as ignition suppressants for pyrotechnics, thereby increasing their safety. There are three salts of primary importance:

$\{H_2NNHC(NNH_2)NHNH_3\}^{+1}\ H_2PO_4^{-1}$ (1)
triaminoguanidinium phosphate, TAGP, and having an empirical formula of $CH_{11}N_6PO_4$;

$\{H_2NNHC(NNH_2)NHNH_3\}_2^{+2}\ HPO_4^{-2}$ (2)
Bis-triaminoguanidinium monoacid phosphate, TAGMP; and $\{H_2NNHC(NNH_2)NHNH_3\}_3^{+3}\ PO_4^{-3}$ (3)
Tris-triaminoguanidinium phosphate, TTGP.

Of the above three salts, TAGP has been the most tested and is the most preferred. By way of example and not limitation, the following two methods of preparation are delineated:

EXAMPLE I

Ion Exchange Method

One hundred eighty-eight (188) grams of Dowex 2-X8 (total exchange capacity 563 mequiv., an ion exchange resin available commercially from Dow Chemical Company) were slurried in water and transferred to a 250 ml buret. The ion exchange resin was washed with a 5% NaOH solution in the conventional fashion to ensure the resin being in the basic form. The resin was subsequently washed with deionized water until the eluate was neutral to pH paper. A solution of 16.7 grams triaminoguanidinium nitrate in 600 ml of deionized water was prepared. This solution was passed through the column containing the ion-exchange resin. When the pH of the eluate became basic, the solution of triaminoguanidinium hydroxide was added to a flask containing 7.0 ml of 85% phosphoric acid diluted with 10 ml of deionized water. After all of the aqueous solution of triaminoguanidine nitrate had been added to the ion-exchange column, the column was washed with deionized water until the effluent was neutral to pH paper, and these washings were also added to the phosphoric acid solution.

The solution of TAGP, formed by the above reaction of phosphoric acid and triaminoguanidinium hydroxide, was concentrated to 50 ml under conditions of low heat and reduced pressures. Absolute methanol (200 ml) was added to the concentrated solution and a white precipitate formed. This product was collected by filtration, washed with absolute methanol and vacuum dried at ambient temperature. The TAGP product weighed 12.9 grams (64% yield) and melted at 174° C. Elemental analyses confirmed that the product was triaminoguanidinium phosphate.

The chemical equations for this set of reactions are as follows:

$$TAGN + Resin^{+}OH^{-} \rightarrow TAG^{+}OH^{-} + Resin^{+}\cdot NO_3^{-}$$

$$TAG^{+}OH^{-} + H_3PO_4 \rightarrow TAGP$$

EXAMPLE II

Free Base Method

Dried triaminoguanidine (95.8 grams, 0.92 mole), prepared by precipitation with dimethylformamide from an aqueous reaction mixture of sodium hydroxide and triaminoguanidinium nitrate, was suspended in 200 ml of deionized water. A nitrogen purge was maintained over the slurry of triaminoguanidine during reaction. The stirred slurry was treated dropwise with 60.0 ml of 85% phosphoric acid (0.88 mole), and, afterwards, heated with a water bath to effect complete solution. After cooling to ambient temperature, absolute methanol (1000 ml) was added to precipitate the product. The product was collected by filtration, washed with absolute methanol and vacuum dried at ambient temperature. The TAGP weighed 129.7 grams (69.7% yield).

The chemical equations for this set of reactions are as follows:

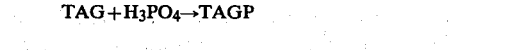

$$TAGN + NaOH \rightarrow TAG + NaNO_3 + H_2O$$

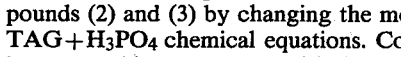

$$TAG + H_3PO_4 \rightarrow TAGP$$

The above examples can be modified to make compounds (2) and (3) by changing the molar ratios in the $TAG + H_3PO_4$ chemical equations. Compound (2) can be prepared in accordance with the following equation:

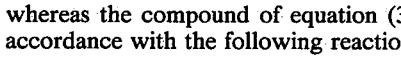

$$2TAG + H_3PO_4 \rightarrow TAGMP$$

whereas the compound of equation (3) is prepared in accordance with the following reaction:

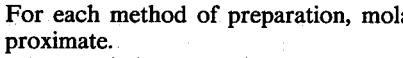

$$3TAG + H_3PO_4 \rightarrow TTGP$$

For each method of preparation, molar ratios are approximate.

Pyrotechnics made with any of the three triaminoguanidinium salts of phosphoric acid will display the desired ignitability characteristics provided that the salt is used in concentrations of from about 2.5 weight percent to about 15 weight percent of the total pyrotechnics. The preferred range is from about 5 to about 10 weight percent of the pyrotechnic composition.

The incorporation of diammonium phosphate (DAP) into low vulverability ammunitions, containing a binder consisting of a copolymer of polyethylene and polypropylene oxides and the oxidizer cyclotetramethylene tetranitramine (HMX), has been found to reduce the composition's flammability. While DAP imparts the desired reduced flammability characteristics, the munition's theoretical performance is severely penalized: approximately 42,000 ft-lbs/lbm (125 Kj/kg) reduction in mass impetus results for each 5-weight percent interchange between DAP and HMX. Similar calculations for an interchange between TAGP and HMX indicates only about 27,400 ft-lbs/lbm (82 Kj/Kg) reduction in mass impetus for each 5-weight percent interchange.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A low vulnerability propellant having improved performance and flammability characteristics comprising a binder, cyclotetramethylene tetranitramine oxidizer, and from about 2.5 to about 15 weight percent of triaminoguanidinium salt of phosphoric acid.

2. A propellant of claim 1 wherein said triaminoguanidinium salt of phosphoric acid is from about 5 to about 10 weight percent of said propellant.

3. The propellant of claim 1 wherein said propellant is a gun propellant.

4. The propellant of claim 1 wherein said propellant is a rocket propellant.

5. The propellant of claim 1 wherein said binder is a copolymer of ethylene oxide and propylene oxide.

6. A method of improving the performance and flammability characteristics of low vulnerability propellants, comprising adding thereto from about 2.5 to about 15 weight percent of a triaminoguanidinium salt of phosphoric acid selected from the group consisting of traminoguanidinium diacid phosphate, bis-triaminoguanidinium monoacid phosphate, and tris-triaminoguanidinium phosphate.

7. The method of claim 6 wherein the amount of said triaminoguanidinium salt of phosphoric acid added is from about 5 to about 10 weight percent of said propellant.

* * * * *